United States Patent [19]

Wikman et al.

[11] 4,154,607

[45] May 15, 1979

[54] PROCESS FOR DISPOSAL OF SODIUM SLUDGE

[75] Inventors: Andrew O. Wikman; Robert L. Say; Robert H. Jones, all of Baton Rouge, La.; James E. Rogers, Pearland, Tex.

[73] Assignee: Ethyl Corporation, Richmond, Va.

[21] Appl. No.: 851,396

[22] Filed: Nov. 14, 1977

[51] Int. Cl.[2] ..... C22D 13/00

[52] U.S. Cl. ..... 75/77; 423/1; 423/155; 423/179; 423/180; 75/66; 204/68

[58] Field of Search ..... 204/68; 423/1, 155, 423/179, 180; 75/66, 77

[56] References Cited

U.S. PATENT DOCUMENTS

| | | | |
|---|---|---|---|
| 2,029,998 | 2/1936 | Gilbert | 75/66 |
| 2,054,316 | 9/1936 | Gilbert | 75/66 |
| 2,073,631 | 3/1937 | Gilbert | 204/68 |
| 2,689,791 | 9/1954 | Boag | 75/66 |
| 2,691,575 | 10/1954 | Larson | 75/77 |
| 2,759,896 | 8/1956 | Hawkes et al. | 252/303 |
| 2,765,328 | 10/1956 | Padgitt | 75/77 |
| 2,863,757 | 12/1958 | Allimier et al. | 75/66 |
| 2,899,296 | 8/1959 | Kreimeier | 75/77 |
| 3,052,535 | 9/1962 | Peters | 75/77 |
| 3,188,199 | 6/1965 | Mattison et al. | 75/77 |

FOREIGN PATENT DOCUMENTS 836447 3/1970 Canada.

*Primary Examiner*—Herbert T. Carter

*Attorney, Agent, or Firm*—Donald L. Johnson; John F. Sieberth; James M. Pelton

[57] ABSTRACT

A process for safely and conveniently disposing of active metal residue, such as a mixture of alkali metal and alkaline earth metal, by introducing the residue into a furnace in which it is completely transformed into harmless metal salts or oxides, which can be disposed of safely and inexpensively.

9 Claims, 2 Drawing Figures

PROCESS FOR DISPOSAL OF SODIUM SLUDGE

BACKGROUND OF THE INVENTION

This invention relates to a process of treating mixtures containing alkali metal in admixture with alkaline earth metal, and more specifically to a process for their safe and economical disposal.

In the production of an alkali metal such as sodium by the electrolytic process it is common practice to utilize as the electrolyte a fused mixture of metal salts. For example, in the production of sodium a fused mixture of sodium chloride and calcium chloride is employed as the electrolyte. The purpose of adding the calcium chloride, is to reduce the melting point of the electrolyte to a temperature below the boiling point of sodium. Optionally, the fused salt bath can also contain barium chloride. In this way, the sodium produced at the cathode will be in the molten state and will not be vaporized at the temperature of the electrolytic mixture. While the use of the fluxing agent such as calcium chloride has this advantage, it does introduce additional difficulties into the overall process. The main difficulty is that calcium metal is produced at the cathode along with the sodium. This crude product is collected, cooled and subsequently filtered so as to recover some of the sodium in substantially pure form. The residue or sludge which remains after this purification contains appreciable quantities of both sodium and calcium and it is the production of this sludge as a by-product which has presented a problem to the industry for a number of years.

The sludge contains on the average about 90–95 weight percent sodium and calcium, the remainder consisting of the various salts and oxides of these metals and other impurities. The sodium content averages about 70 percent by weight and the calcium content varies between 5 and 30 percent. The sludge is in the form of crystals of calcium metal and electrolyte embedded in a matrix of sodium.

It is necessary to either convert this sludge into a usable commercial product or dispose of the material in some suitable manner. Although workable processes have been described for converting the sludge into useful products (note, for example, U.S. Pat. No. 2,759,896 and Canadian Pat. No. 836,447), these processes are not used commercially because of the costs and hazards associated with handling and processing the large volumes of sludge produced in commercial facilities.

Accordingly, the disposal of such sludge is still the only practical and feasible alternative. One such disposal method presently in use is to collect the active sludge in 55-gallon drums, transport the drums to a suitable ocean dumping site, perforate the drums and toss them overboard. The contact between the active metal sludge and the water is vigorous, but harmlessly converts the sludge to oxidation products of no real danger. This method is costly and involves transporting the sludge over considerable distances. A significant contribution to the art would be an alternative sludge disposal method, that would be a safe, convenient, economical, controllable, complete and environmentally acceptable process or method for disposing of this sludge. Such a process or method is provided by this invention.

SUMMARY OF THE INVENTION

In accordance with this invention, sodium filter sludge which results from the manufacture of sodium is introduced into a furnace maintained at a temperature sufficient to oxidize said sludge substantially completely and for a time sufficient to allow a substantial portion of the sludge oxidation products to participate in forming a slag layer within said furnace and the slag is recovered from the furnace, either continuously or periodically. An oxidizing atmosphere of air or oxygen is maintained within the furnace.

DESCRIPTION OF PREFERRED EMBODIMENTS OF THE INVENTION

From the nature of the active metal residue, any process for its disposal must consider numerous aspects, including personnel safety, environmental effects, process reliability and equipment life. The present invention makes use of facilities employed in the treatment of other process by-product materials without degradation of the recycle product, without deterioration of the disposal equipment and without risk to personnel.

Figure 1:
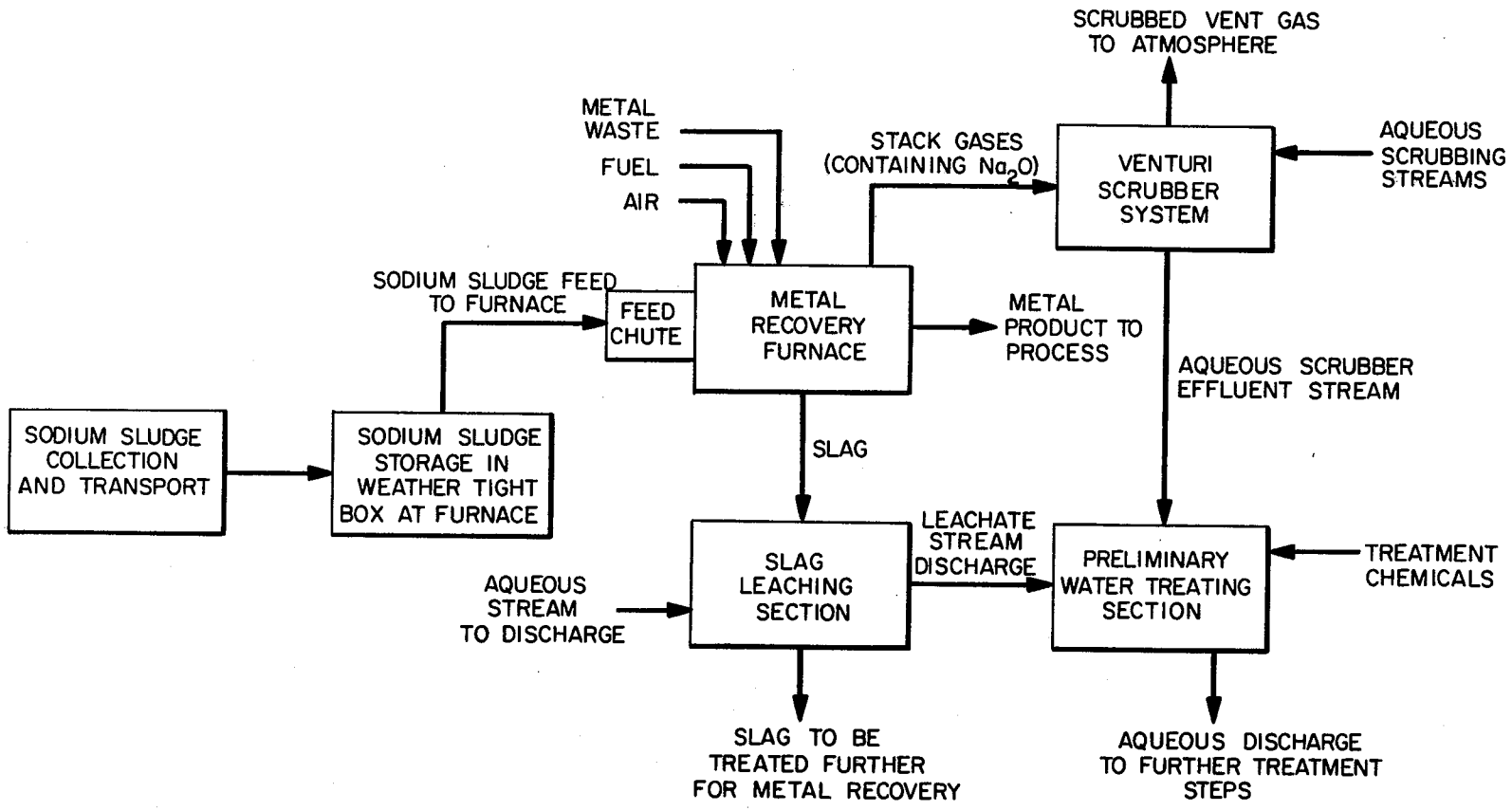
FIG. 1 is a schematic representation of a sludge disposal process in accord with this invention for conversion of active metal sludge to innocuous metal salts and oxides.

Generally, as shown schematically in FIG. 1, the process of the present invention includes collecting the sludge and transporting it to a site near a furnace, feeding the sludge to a furnace used for recovery of metal, treating the furnace flue gases with water in a scrubber system, separating the slag from the furnace and leaching the slag to remove water soluble salts. In some cases, it may be desirable to send the leached slag for secondary recovery of the metal.

When certain feed techniques are employed as described hereinafter, the otherwise serious attack of the active metal sludge upon the firebrick lining of the furnace can be substantially lessened. It is known that active metals, e.g., sodium and calcium and their oxides will result in accelerated deterioration of typical furnace brick. Furnace brick is of special composition depending upon which section of the furnace is considered. For example, in a reverberatory furnace one type of brick is used for the floor, another type for lower side walls in the area contacted by the molten metal contents and slag, and still another type for the upper side walls and roof. Each type of brick is selected for its ability to withstand the conditions prevailing in the zone in which it is used. The brickwork and mortar gradually deteriorate in service and must be replaced periodically. This involves considerable downtime and expense. In addition to reverberatory furnaces, other types of furnaces can be used in the process of this invention, although many of these would be economically or technically unpracticable. For example, muffle furnaces, electric arc furnaces, blast furnaces and rotary kilns can be mentioned as typical. However, in a preferred embodiment of this process of disposing of sludge, a reverberatory furnace has been found to be quite useful.

The furnace employed generally operates at temperatures sufficient to melt the active metal sludge rapidly. Further, many types of furnaces operate with an oxidizing atmosphere which burns at least a portion of the active metal sludge, forming oxidation products which are carried out of the furnace with the flue gases.

Temperatures in the furnace should be sufficient to oxidize or react sludge with the slag or both substantially completely and in a reasonable time. Typical furnace temperatures are usually greater than about 450° C. More preferably, temperatures in the furnace will range from about 600° up to about 950° C. or greater depending on the type and size of furnace, the fuel, the amount and velocity of combustion air and other such factors common to furnace operation. Most preferably, the furnace can be maintained at an operating temperature in the range of about 700° to about 850° C., again depending on the above-mentioned factors and also on the efficiency of burning the sludge which at this temperature occurs within a reasonable time.

In general, the time for burning is inversely proportional to the temperature of the furnace and directly proportional to the amount of sludge fed per pound of metal melt in the furnace. Typically, from 150 to about 500 pounds of sludge per shift can be fed to furnaces of commercial size. Preferably, from about 0.1 to about 50 parts of sludge per thousand parts of metal melt can be processed in accord with the present invention.

The sludge will be completely burned, i.e., entirely lose its character and properties as sludge, either from direct oxidation in the combustion or from melting and reacting in the slag and/or metal melt layer, within about 0.5 to about 2 hours from introduction of the sludge as a solid, discrete entity. If fed in different forms such as a powder, or already in a molten state, less time may be required. However, the problems associated with formation and handling of powdered sludge and with maintenance of sludge at molten conditions militate against such practices. Sufficient time, as indicated above, for complete processing of the sludge is required to completely deactivate the active alkali metal content of the sludge. Greater times than those given above are useable but may not be practical or economical. Also, lesser times than above indicated under more severe conditions can also be employed, provided that complete deactivation of the sludge, in the form of oxidation products, is accomplished.

It is, however, required that sufficient time be allowed for complete oxidation of the active metal and for a substantial portion of the sludge oxidation products to participate in forming a slag layer within the furnace. Usually, complete separation is impossible since small quantities will remain trapped in the furnace and not become associated with the slag layer. However, after a period of heating under furnace conditions of 4 to about 16 hours, the sludge oxidation products are substantially completely contained within the slag layer. Preferably, a substantial portion of the sludge oxidation products are in the slag layer after a period of from about 6 to about 10 hours, and, most preferably, the process can be completed within a period of a normal 8-hour working shift. Thus, within one shift period a furnace can be fed with sodium-calcium sludge, allowed to substantially oxidize and participate in the formation of the slag layer and the slag containing a substantial portion of the sludge oxidation products can be recovered.

In addition to being removed by slagging, active metal sludge oxidation products in the form of small particles also become entrained in the combustion gases of the furnace and are blown out the furnace flue or stack. To prevent this entrained material from escaping to the atmosphere, the flue gases are contacted with water in a scrubber and a substantial portion of the sludge oxidation products so entrained are prevented from entering the atmosphere.

As a preferred embodiment of the process of this invention, sodium-calcium sludge is introduced into a reverberatory furnace used primarily for the recovery of lead metal which introduction completely, safely, conveniently and controllably burns the sludge to harmless oxidation products without unacceptable harm to the furnace firebrick, adverse furnace operation, or contamination of the product lead metal.

In general, lead by-product from the manufacture of lead antiknock compounds commonly called lead sludge is processed in a lead recovery furnace of the reverberatory type to yield molten lead for recycle and a lead-containing slag that is further treated for additional lead recovery. The heavy, molten lead sinks to the bottom of the furnace and is periodically tapped from the furnace. The lighter slag floats on the molten lead and is periodically skimmed from the surface. The furnace burners and lead sludge feed are both at one end of the furnace. The flue gases are taken off from the other end and passed through a high energy venturi scrubber for removal of particulates before release to the atmosphere.

More particularly, the sodium-calcium sludge is collected into conveniently sized cartons in a molten state which is a thick viscous melt and is then allowed to cool and solidify. The molten sludge is at 110° to about 115° C. and requires from about 1 to about 2 hours to cool and solidify. The cartons are transported to the furnace area for storage under weather-proof conditions until time for use. Weather-proof storage is desirable to avoid the hazard of contact with water.

At the furnace, the cartons are periodically removed from the weather-proof storage box and introduced into the furnace. The introduction is preferably done by a separate feed mechanism to avoid contact with other materials. For example, one method of introduction is to place the cartons in a steel chute attached to the side of the furnace and push the cartons into the furnace with a piston-rod injector device. After reading this disclosure, other sludge feeding techniques can be readily envisioned by skilled engineers and the above-described method should be considered illustrative and non-limiting.

It is also preferred to introduce the sludge-containing cartons into the central portion of the furnace so that as the sludge melts and oxidizes, it will be converted into harmless oxidation products before a substantial portion of the active metals contained therein contact the furnace firebrick sidewalls, which can lead to faster brick deterioration.

Figure 2:
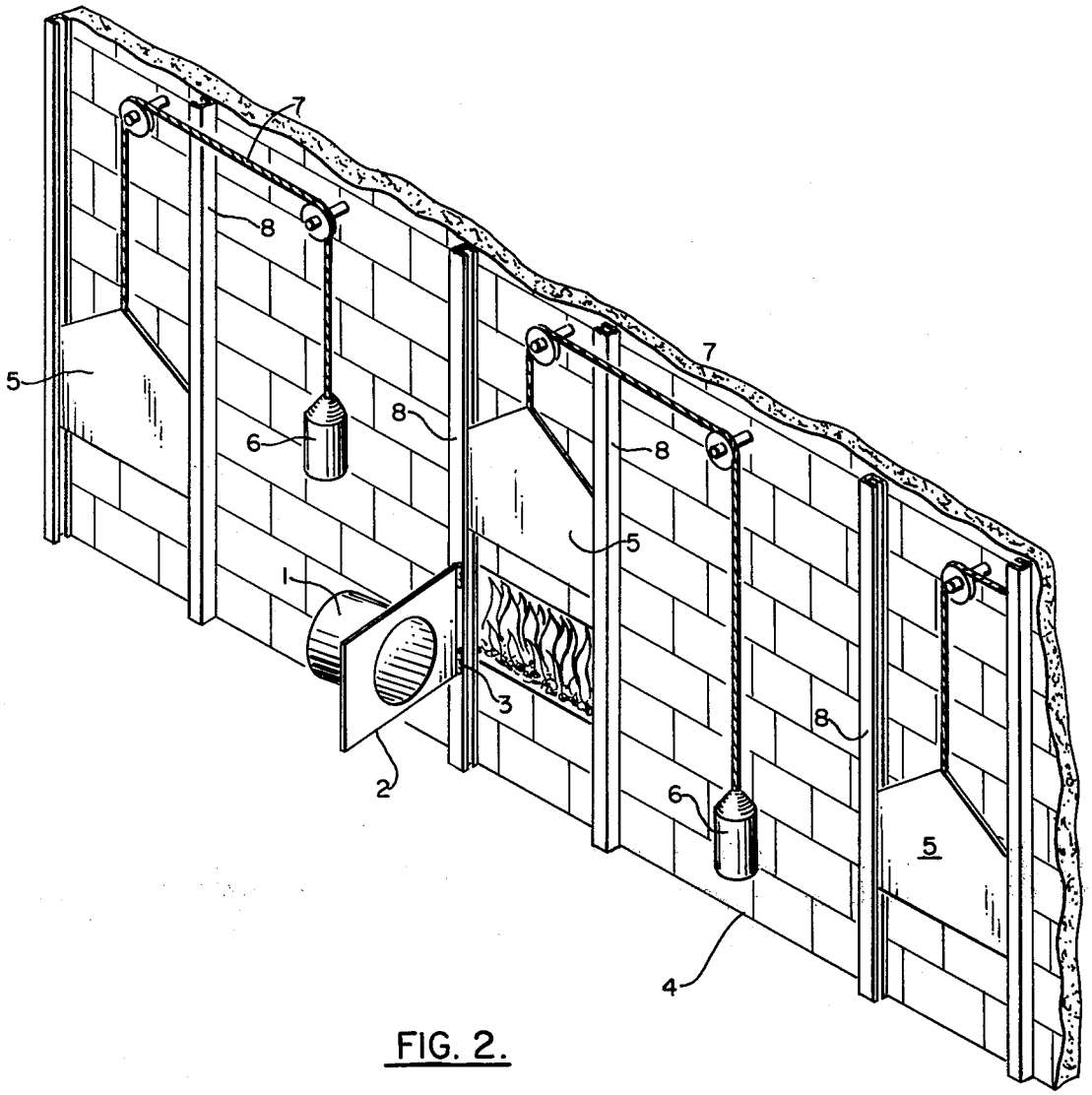
FIG. 2 is a partial side perspective view of a furnace showing a preferred feed mechanism for introducing the active alkali metal sludge into the central part of a reverberatory furnace.

As more pictorially shown in FIG. 2, it is preferred to employ a feed system generally composed of a cylindrical feed chute 1 around one end of which is disposed a generally square end flange 2 having hinges 3 attaching the feed chute to the furnace 4. As used in operation, slag door 5 is raised by pulling weight 6 attached to cable 7 which has its other end attached to slag door 5. The slag door 5 slides up behind guide bars 8 exposing the interior of furnace 4. The feed chute 1 is swung into position over the opening and a carton of sludge is placed into the chute and pushed into the central portion of the furnace interior where it burns safely and with less tendency of the active alkali metal to contact the furnace brick until converted or burned into harmless oxidation products.

Upon introduction into the furnace, the sludge begins to melt and burns with a portion thereof forming alkali metal oxide particulate material which becomes entrained in the flue or stack gases and the major portion participating in the formation of the slag layer, also as their oxides. The slag layer is periodically removed from the furnace, leached with water to dissolve water-soluble salts and finally the leached slag is processed to recover the remaining lead. The overall effect of this process is the conversion of the active metal content, i.e., the sodium and calcium metal, of the sludge to innocuous salts and oxides without any substantial adverse affect on the recovery of lead and at considerable savings over previously employed or contemplated disposal techniques involving more complicated equipment and more dangerous reactions.

The following description illustrates a preferred embodiment of the present invention and is non-limiting with respect to the concept of the invention. The process of the present invention was tested by burning sodium-calcium sludge from the electrolytic manufacture of sodium in a reverberatory lead recovery furnace during otherwise normal furnace operations. The test was carried out by the addition of about 100 pounds of sodium/calcium sludge to the furnace containing about 100,000 pounds of lead per 8-hour shift. Data were taken during the day shift each day of test on the furnace stack discharge gases for opacity, water flow rates to the stack gas precooler and scrubber, stack temperatures before and after addition of the sodium/calcium sludge and scrubber gas inlet temperature. Samples of the combined scrubber and precooler water were taken and analyzed for alkalinity to determine the amount of sodium oxide fumes scrubbed from the furnace gases and total solids to estimate scrubber loading. The lead product and slag were also sampled at various times to determine the effect of the addition of the sodium/calcium sludge to the furnace. The data and sample analyses are given in the tables below:

Table I

Summary of Furnace Operating Conditions

| Test Day | 1 | 2 | 3 |
|---|---|---|---|
| Opacity* of stack plume | 15% | 10% | 10% |
| Stack gas temperature (°C.) | | | |
| Before addition of Na/Ca sludge | 810 | 830 | 850 |
| Maximum after Na/Ca sludge addition | 880 | 910 | 910 |
| Scrubber inlet temperature (°C.) | 95 | 95 | 100 |
| LWater flow to | | | |
| Precooler (GPM) | 20 | 20 | 23 |
| Scrubber (GPM) | 16 | 16 | 20 |
| Scrubber fan horsepower | 70 | 65 | 65 |

*Based on subjective observations and remained essentially uchanged throughout test run.

Table II

| Day No. | Sodium and Calcium Concentration in Lead Product PPM Sodium | Calcium | |
|---|---|---|---|
| 0 | 59 | 47 | Day before test started |
| 1 | 63 | 40 | |
| 2 | 40 | 28 | |
| 3 | 43 | 39 | |

Table II-continued

| Day No. | Sodium and Calcium Concentration in Lead Product PPM Sodium | Calcium | |
|---|---|---|---|
| 4 | 51 | 33 | Shift after test ended |

The amount of $Na_2O$ as equivalent sodium removed in the scrubber is shown in the analyses of the water samples. These results are shown in the following table:

Table III

Summary of Analyses on Water Samples

| | Lbs/Min Equivalent Na in Water* Day 1 | Day 2 | Day 3 |
|---|---|---|---|
| Process Water** | 0.03 | 0.03 | 0.03 |
| Before Start | .02 | .03 | .02 |
| Elapsed Time, Min. | | | |
| 0 | — | — | .04 |
| 2 | — | — | .37 |
| 4 | — | — | 1.23 |
| 5 | .25 | .64 | — |
| 6 | — | — | 0.94 |
| 8 | — | — | .75 |
| 10 | — | — | .39 |
| 15 | — | — | .05 |
| 20 | .05 | .05 | — |
| 30 | — | — | .07 |

*Represent rates calculated from grab sample of combined precooler and scrubber water discharge.
**Sampled process water inlet; all other samples are effluent.

The molten slag composition during the test is shown in Table IV below:

Table IV

Analysis of Molten Slag

| | Weight % In Molten Slag On O-Day | 1st Day | 2nd Day | 3rd Day | 4th Day |
|---|---|---|---|---|---|
| NaCl | 51.0 | 49.0 | 48.8 | 33.8 | 39.1 |
| NaOH | 8.7 | 14.9 | 15.2 | 26.3 | 27.4 |
| $Na_2SO_4$ | 38.2 | 32.2 | 33.4 | 34.3 | 28.3 |
| Water Insoluble | 0.4 | 0.8 | 1.0 | 1.3 | 1.1 |
| Unaccounted for | 1.7 | 3.1 | 1.6 | 4.3 | 4.1 |
| Total | 100.0 | 100.0 | 100.0 | 100.0 | 100.0 |

From the above tables and data taken during the test, it was concluded that the introduction of Na/Ca sludge into the furnace had no appreciable adverse effects. The opacity of the stack plume was not significantly changed. The operating temperatures rose only about 50° to about 100° C. during the actual burning time. The increase in equivalent sodium removed in the furnace scrubbing system peaked quickly after introduction, at about 4 minutes and at a rate of about 1.2 pounds equivalent sodium per minute and then rapidly dropped back to normal in about 10–15 minutes. The product lead samples showed no increase in sodium and calcium content after addition of the Na/Ca sludge. Although time has not been sufficient to determine the long term effects of the process of this invention on furnace brick life, no gross effects were noted during the test.

In a similar test conducted three weeks after the first test, similar results were obtained.

The present invention is not limited to the type of furnace or operation of a metal recovery furnace or to operating conditions given in the illustrative example hereinabove. Those skilled in the art will appreciate variations in the process of the present invention within the spirit and scope of the foregoing disclosure. Therefore, it is desired that the present invention be limited only within the lawful scope of the following claims.

What is claimed is:

1. The process for disposal of sodium sludge which results from the electrolytic manufacture of sodium comprising introducing said sludge into the melt of a reverberatory lead recovery furnace maintained at a temperature greater than about 450° C. over a period of from about 4 to about 16 hours in an oxidizing atmosphere whereby said sludge is substantially completely oxidized and a substantial portion of the sludge oxidation products participate in forming a slag layer within said furnace, tapping off said molten lead and recovering said slag, whereby said sludge oxidation products are removed with and as a part of said slag thereby disposing of said sodium sludge safely, economically and without affecting recovery of lead from said furnace.

2. The process of claim 1 in which said furnace is maintained at a temperature from about 600° to about 950° C.

3. The process of claim 1 in which said furnace is operated with an oxidizing atmosphere internally and at a temperature of from about 700° to about 850° C.

4. The process of claim 1 in which said sludge and/or the oxidation products thereof are maintained in said furnace for a period of from about 6 to about 10 hours.

5. The process of claim 1 in which from about 0.1 to about 50 parts of said sludge per thousand parts of the furnace feed material are employed.

6. The process of claim 1 further characterized in that a portion of said oxidation products which are formed in said furnace are entrained with the furnace flue gases and contacting said products with water whereby a major amount of said portion is removed from the flue gases and prevented from entering the atmosphere.

7. The process of claim 1 further characterized by treatment of said slag with water in atmospheric leach pits to remove water soluble salts and sending the leached slag for secondary recovery of the contained lead content.

8. The process of claim 1 wherein said sludge, prior to treatment thereof in said furnace, is collected from a sodium sludge filter, cooled, transported to said furnace and stored in weather-proof containers.

9. The process of claim 1 wherein said sludge is introduced into said furnace in a central portion thereof.

* * * * *

UNITED STATES PATENT OFFICE

CERTIFICATE OF CORRECTION

PATENT NO. : 4,154,607

DATED : May 15, 1979

INVENTOR(S) : Andrew O. Wikman et al

It is certified that error appears in the above-identified patent and that said Letters Patent are hereby corrected as shown below:

Column 5, line 54, in Table I, "LWater" should read -- Water --.
Column 8, line 11, in Claim 6, "said oxidation" should read -- said sludge oxidation --.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*